US007184877B1

(12) United States Patent
de Ojeda

(10) Patent No.: US 7,184,877 B1
(45) Date of Patent: Feb. 27, 2007

(54) MODEL-BASED CONTROLLER FOR AUTO-IGNITION OPTIMIZATION IN A DIESEL ENGINE

(75) Inventor: William de Ojeda, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/238,379

(22) Filed: Sep. 29, 2005

(51) Int. Cl.
*F02D 43/04* (2006.01)
*F02D 41/14* (2006.01)

(52) U.S. Cl. ..... 701/104; 701/105; 701/108; 123/305

(58) Field of Classification Search ..... 701/102, 701/103, 115, 104, 105, 108; 123/90.11, 123/90.12, 90.15, 295, 480, 305
See application file for complete search history.

(56) References Cited

U.S. PATENT DOCUMENTS

| | | | | |
|---|---|---|---|---|
| 6,044,815 | A | 4/2000 | de Ojeda | |
| 6,161,524 | A | 12/2000 | Akbarian et al. | |
| 6,263,842 | B1 | 7/2001 | de Ojeda | |
| 6,286,482 | B1 | 9/2001 | Flynn et al. | |
| 6,543,411 | B2 * | 4/2003 | Raab et al. | 123/305 |
| 6,550,444 | B2 * | 4/2003 | Shiraishi et al. | 123/294 |
| 6,792,924 | B2 | 9/2004 | Aoyama et al. | |
| 6,971,365 | B1 * | 12/2005 | Najt et al. | 123/305 |
| 6,994,072 | B2 * | 2/2006 | Kuo et al. | 123/295 |

OTHER PUBLICATIONS

U.S. Appl. No. 10/974,639, filed Oct. 27, 2004, de Ojeda et al.

U.S. Appl. No. 11/227,010, filed Sep. 15, 2005, Bulicz et al.

Vafidis, C., "The Application Of An Electro-Hydraulic VVA System On A Passenger Car C.R. Diesel Engine," Paper No. 20A2011, Associacioni Tecnica De Automobile, Congress on The Future of Diesel Engine Technology for Passenger Cars, Porto Cervo, Italy, Oct. 12-13, 2000.

Agrell, Fredrik, Hans-Erik Angstrom, Bengt Eriksson, Jan Wikander, and Johan Linderyd "Integrated Simulation and Engine Test of Closed Loop HCCI Control by Aid of Variable Valve Timings," SAE Paper No. 2003-01-0748, SAE World Congress, Mar. 3-5, 2003, SAE International, Warrendale, PA.

(Continued)

*Primary Examiner*—Andrew M. Dolinar
*Assistant Examiner*—Johnny H. Hoang
(74) *Attorney, Agent, or Firm*—Susan L. Lukasik; Elias P. Soupos; Jeffrey P. Calfa

(57) ABSTRACT

A diesel engine (10) operates by alternative diesel combustion. Formation of fuel and charge air mixtures is controlled by processing a particular set of values for certain input data according to a predictor algorithm model (50) to develop data values for predicted time of auto-ignition and resulting torque, and also develop data values for control of fuel and air that will produce the predicted time of auto-ignition and resulting torque. The data values developed by the predictor algorithm and data values for at least some of the input data are processed according to a control algorithm (52) that compensates for any disturbance introduced into any of the data values for at least some of the input data being processed by the control algorithm. This causes the systems to be controlled by compensated data values that produce predicted time of auto-ignition and resulting torque in the presence of any such disturbance.

22 Claims, 4 Drawing Sheets

OTHER PUBLICATIONS

Wolters, P., W. Salber, J. Geiger, M. Duesmann, and J. Dilthey, "Controlled Auto Ignition Combustion Process with an Electromechanical Valve Train," SAE Paper No. 2003-01-0032, SAE World Congress, Mar. 3-6, 2003, SAE International, Warrendale, PA.

* cited by examiner

80

$$\delta M_f = \alpha_{TQ}(\varepsilon_{TQ,dty}) * g_{TQ} - \alpha_{\theta AI}(\varepsilon_{\theta AI,dty}) * g_{\theta AI}$$

82

$$\delta\zeta_{IVC} = \beta_{TQ}(\varepsilon_{TQ,dty}) * h_{TQ} + \beta_{\theta AI}(\varepsilon_{\theta AI,dty}) * h_{\theta AI}$$

90

$$\Delta TQ = r(\delta\zeta_{IVC}) + \bullet(\delta M_f) \approx \bullet(\delta M_f)$$

92

$$\Delta\theta_{AI} = \bullet(\delta\zeta_{IVC}) + \bullet(\delta M_f)$$

MODEL-BASED CONTROLLER FOR AUTO-IGNITION OPTIMIZATION IN A DIESEL ENGINE

FIELD OF THE INVENTION

This invention relates to diesel engines that at times operate by alternative diesel combustion (ADC) processes, such as HCCI, CAI, DCCS, or HPCS, to cause auto-ignition of an air-fuel mixture as the mixture is being compressed in an engine cylinder.

BACKGROUND OF THE INVENTION

HCCI (homogeneous charge compression ignition) is a recognized process for fueling a diesel engine in a manner that creates a substantially homogeneous air-fuel charge inside an engine cylinder during a compression upstroke of an engine cycle. After a desired quantity of fuel for the charge has been injected into the cylinder to create a generally homogeneous air-fuel mixture, the increasing compression of the charge by the upstroking piston creates sufficiently large temperature to cause auto-ignition of the charge near or at top dead center (TDC). Auto-ignition may occur as the substantially simultaneous spontaneous combustion of vaporized fuel at various locations within the mixture.

One of the attributes of HCCI is that relatively lean, or dilute, mixtures can be combusted, keeping the combustion temperatures relatively low. By avoiding the creation of relatively higher combustion temperatures, HCCI can yield significant reductions in the generation of $NO_x$, an undesired constituent of engine exhaust gas.

Another attribute of HCCI is that auto-ignition of a substantially homogeneous air-fuel charge generates more complete combustion and consequently relatively less soot in engine exhaust.

The potential benefit of HCCI on reducing tailpipe emissions is therefore rather significant, and consequently HCCI is a subject of active investigation and development by many scientists and engineers in the engine research and design community.

HCCI may be considered one of several alternative combustion processes for a compression ignition engine. Other processes that may be considered alternative combustion processes include Controlled Auto-Ignition (CAI), Dilution Controlled Combustion Systems (DCCS), and Highly Premixed Combustion Systems (HPCS).

By whatever name an alternative combustion system or process may be called, a common attribute is that fuel is injected into a cylinder well before TDC to form an air-fuel charge that is increasingly compressed until auto-ignition occurs near or at top dead center (TDC).

If such alternative processes are not suitable over the full range of engine operation for any particular engine, the engine may be fueled in the traditional conventional diesel manner where charge air is compressed to the point where it causes the immediate ignition of fuel upon fuel being injected into a cylinder, typically very near or at top dead center where compression is a maximum.

With the availability of processor-controlled fuel injection systems capable of controlling fuel injection with precision that allows fuel to be injected at different injection pressures, at different times, and for different durations during an engine cycle over the full range of engine operation, a diesel engine becomes capable of operating by alternative combustion processes and/or traditional diesel combustion. The advent of variable valve actuation systems allows timing of engine valves to be processor-controlled in various ways, and with precision.

As will be explained by later description, the present invention takes advantage of the capabilities of such processor-controlled fuel and valve actuation systems to better control auto-ignition when a compression ignition engine is operating in an alternative diesel combustion mode.

Because a diesel engine that powers a motor vehicle runs at different speeds and loads depending on various inputs to both the vehicle and the engine that influence engine operation, fueling requirements change as speed and load change. An associated processing system processes data indicative of parameters such as engine speed and engine load to develop control data for setting desired engine fueling for particular operating conditions. A control algorithm seeks to secure fuel injection system operation that will provide the desired fueling at each of various combinations of engine speed and engine load.

A variable valve actuation system can also be controlled in different ways according to different engine speed-load conditions to provide effective compression ratio appropriate to each of multiple combinations of those conditions. A control algorithm seeks to secure a desired effective compression ratio that in conjunction with fueling determined by the fuel control algorithm will cause auto-ignition of an in-cylinder mixture to occur at a desired time in the engine cycle that creates desired torque at the particular engine speed.

Even with good control of both fueling and cylinder valve timing, disturbances that create cylinder-to-cylinder variations and/or cycle-to-cycle variations in auto-ignition and resulting torque may be present in an engine. Too early auto-ignition can cause certain undesired effects like potentially damaging engine knock. Too late auto-ignition can result in power loss. These disturbances may be inherent in the design of a particular engine, typically because each cylinder is at a different location in the engine and may therefore operate at a small but nonetheless significant temperature difference from other cylinders and/or may at a different distance from the point at which charge air enters the intake manifold than other cylinders.

SUMMARY OF THE INVENTION

Management of both air and fuel are important in achieving auto-ignition at a desired time during the engine cycle when a diesel engine is operating by an alternative combustion process. The availability of processor-controlled variable valve actuation systems can operate engine valves in ways for managing airflow into the cylinders to achieve a desired quantity of charge air in the mixture compressed in each cylinder. Likewise, the quantity of fuel in the mixture can be well controlled by processor-controlled fuel systems. As engine operating conditions change, fuel and air can be varied in ways appropriate for changing conditions.

HCCI, DCCS, HPCS, and other alternative internal combustion processes have disclosed, both theoretically and experimentally, the possibility of significant reductions in engine-out emission level, including NOx and soot. One of the factors that can be used effectively for accomplishing these reductions is effective compression ratio. It is believed that an industry-accepted definition for effective compression ratio is the ratio of in-cylinder pressure at the end of a compression stroke to the in-cylinder pressure at the end of an effective intake stroke. Controlling the amount of charge air that is allowed to enter a cylinder will control the effective compression ratio.

The present invention employs variable valve actuation and fuel control strategies for achieving air-fuel mixtures that will auto-ignite at the proper time in the engine cycle to provide the desired torque at the speed at which the engine is running.

These variations include intake manifold temperature and exhaust gas recirculation.

The invention seeks to control certain variables (control variables) so as to minimize variations in characteristics of auto-ignition (e.g., variations in time of auto-ignition from cycle-to-cycle in a particular cylinder or variations from cylinder-to-cylinder) that tend to occur when fuel is introduced into a cylinder relatively early in a compression upstroke and auto-ignition is delayed significantly so as to allow the fuel and charge air to better mix before auto-ignition actually occurs.

Certain variables (disturbance variables and manipulated variables) affect auto-ignition. One variable that affects auto-ignition is temperature of the air-fuel mixture that is being compressed. Proper control of that temperature can avoid premature auto-ignition that could cause severe knock and lead to engine damage. Certain prior attempts to control mixture temperature have been directed toward (a) optimization of piston geometry to enhance mixture homogeneity, (b) limiting effective compression ratio (in the case of Diesel or high cetene fuels lowering compression ratio is desired since these fuels ignite easily as compared to gasoline fuels) to limit in-cylinder temperature rise, (c) optimization of fuel injection strategy (e.g., sequence and relative contributions of multiple injections), (d) optimization of the amount of exhaust gas re-circulation (EGR) and EGR temperature, and (e) optimization of the valve timing sequence.

The present invention provides a control strategy that compensates control variables in a manner that attenuates the influence of multiple sources of noise (disturbance variables) that affect the auto-ignition process. Whereas previous techniques have employed certain hardware additions or modifications in efforts to minimize the influence of noise, the present invention embodies a model-based approach that guards against engine misfire caused by typical disturbances found in an engine. By containing misfire, the invention provides a robust auto-ignition process.

Disturbances can arise in various ways such as from uneven cooling of various cylinders, variations in air-charge at each cylinder owing to non-identical airflow patterns through the intake system to the individual cylinders, uneven firing order, and unequal distribution of EGR gases. The inventive strategy provides control over each cylinder injector and a variable valve timing mechanism where the valve timing may be adjusted at each cylinder. The disclosed embodiment described here controls individual cylinder fueling and intake valve closing as manipulative variables, while accounting for the presence of disturbances like those mentioned as disturbance variables, to yield values for control of air and fuel management systems that will cause auto-ignition at the proper time in the engine cycle to produce desired torque.

It is believed that the invention not only can reduce engine-out emissions, but also can contribute to improvements in other aspects of engine performance in a motor vehicle. Moreover, the invention can be embodied in a cost-effective manner in production vehicles that already have electronic engine control systems and variable valve actuation systems because it is embodied in the control strategy.

Various mechanisms that are disclosed in various patents and technical literature may be used to change effective compression ratio of an engine. Examples are described in commonly owned U.S. Pat. Nos. 6,044,815 and 6,263,842. They comprise hydraulically-assisted engine valve actuators that can change individual valves and control individual cylinders for better combustion control and that are useful in compensating for different charge temperatures resulting from different cylinder locations in an engine.

The present invention relates to an engine, system, and method for enhancing the use of alternative combustion processes in a diesel engine toward objectives that include further reducing the generation of undesired constituents in engine exhaust, especially soot and $NO_x$. The invention is embodied in air and fuel management strategies. The air management strategy uses variable valve actuation to control intake valve closing. The strategies are implemented by suitable programming in an associated processing system of an engine control system.

One generic aspect of the present invention relates to a method of operating a compression ignition engine that has a processor-based engine control system controlling both a fueling system for fueling the engine and a variable valve actuation system that controls operation of intake valves that open and close an intake system to individual engine cylinders.

The method comprises processing certain data to develop both fueling data for fueling an engine cylinder and intake valve operating data for operating an intake valve for the cylinder. The intake valve operating data is developed by execution of an algorithm in the control system that controls ECR of the cylinder for causing commencement of auto-ignition of fuel in the cylinder to occur during a compression stroke in advance of top dead center at an in-cylinder temperature within a defined temperature range. The cylinder is fueled according to the fueling data.

The variable valve actuation system is controlled according to the intake valve operating data to allow air to pass from the intake system through the intake valve into the cylinder in an amount that causes commencement of auto-ignition of fuel in the cylinder to occur during the compression stroke in advance of top dead center at an in-cylinder temperature within the defined temperature range.

A further generic aspect relates to a compression ignition engine comprising cylinders within which combustion occurs to run the engine, a fueling system for fueling the cylinders, an intake system for introducing charge air into the cylinders, including a variable valve actuation system that controls operation of intake valves that open and close the intake system to individual engine cylinders, and a processor-based engine control system controlling both the fueling system and the variable valve actuation system.

The processing portion of the control system processes certain data to develop fueling data for fueling the engine cylinders and intake valve operating data for operating the cylinder intake valves.

The intake valve operating data is developed by execution of an algorithm in the control system that controls ECR of the cylinders for causing commencement of auto-ignition of fuel in the cylinders to occur during compression strokes in advance of top dead center at in-cylinder temperatures within a defined temperature range.

A more specific aspect of both the method and engine is that the intake valves begin to open at or near the beginning of an intake stroke immediately preceding the compression stroke and close before the conclusion of the intake stroke. The closing occurs sufficiently before the conclusion of the intake stroke to allow expansion of in-cylinder air during the remainder of the intake stroke sufficient to create some decrease in in-cylinder temperature.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
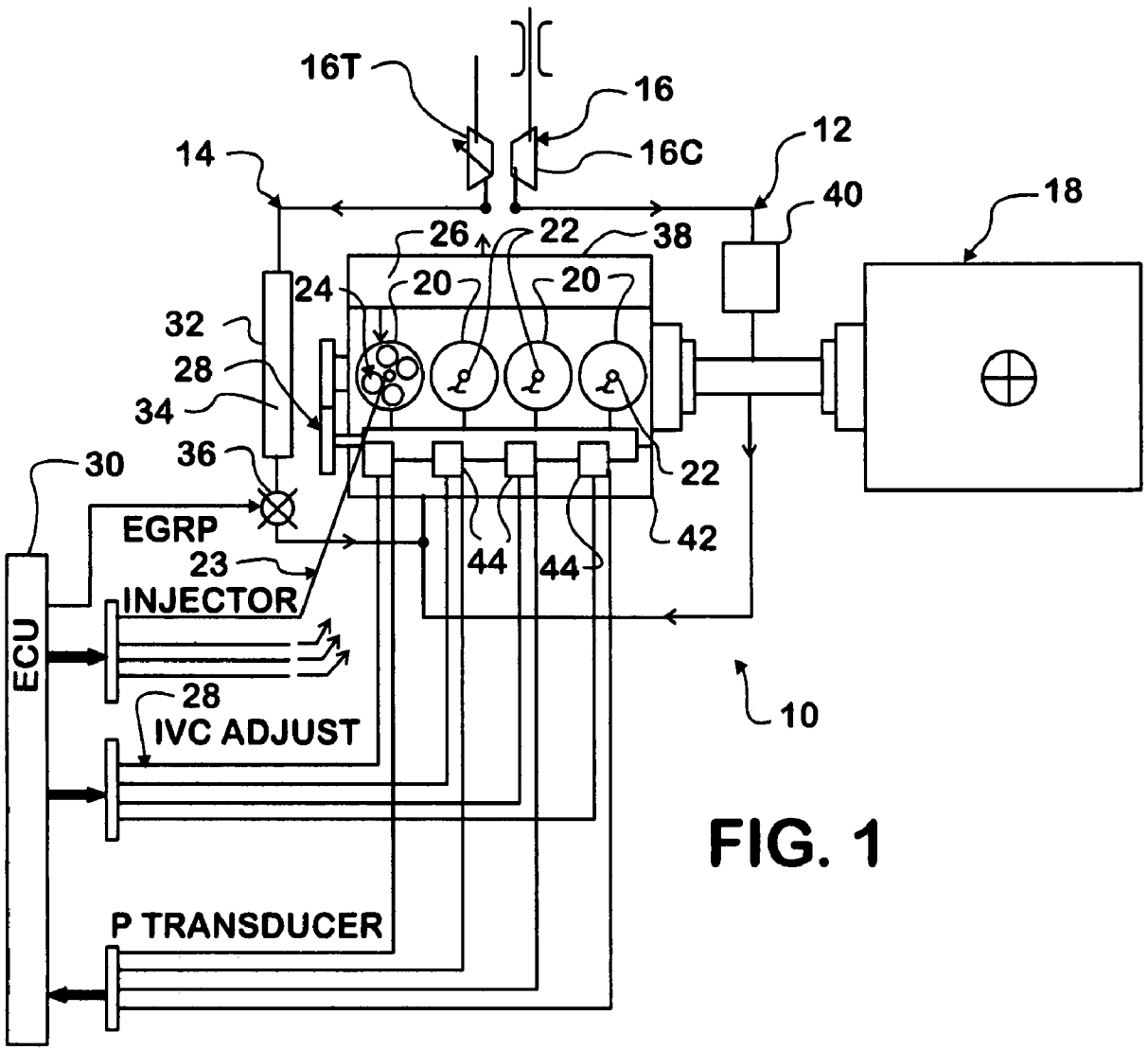
FIG. 1 is a schematic diagram of an engine and associated devices relevant to principles of the invention.

FIG. 1 shows portions of an exemplary internal combustion engine 10 that embodies principles of the present invention. Engine 10 comprises an intake system 12 through which charge air for combustion enters the engine and an exhaust system 14 through which exhaust gases resulting from combustion exit the engine. Engine 10 operates on the principle of compression ignition, and is turbocharged by a turbocharger 16 that has a turbine 16T in exhaust system 14 and a compressor 16C in intake system 12. When used as the prime mover of a motor vehicle, such as a truck, engine 10 is coupled through a drivetrain 18 to driven wheels that propel the vehicle.

Engine 10 comprises multiple cylinders 20 (either in an in-line configuration of a V-configuration) forming combustion chambers into which fuel is injected by fuel injectors 22 as elements of a fuel management system 23 to mix with charge air that has entered through intake system 12. Pistons that reciprocate within cylinders 20 are coupled to an engine crankshaft.

An air-fuel mixture in each cylinder 20 combusts under pressure created by the corresponding piston as the engine cycle passes from its compression phase to its power phase, thereby driving the engine crankshaft, which in turn delivers torque through drivetrain 18 to the wheels that propel the vehicle. Gases resulting from combustion are exhausted through exhaust system 14.

Engine 10 has intake valves 24 and exhaust valves 26 associated with cylinders 16. A variable valve actuation mechanism 28 is part of an air management system that opens and closes at least the intake valves and may also open and close the exhaust valves. Each cylinder has at least one intake valve and at least one exhaust valve.

Engine 10 also comprises an engine control unit (ECU) 30 that comprises one or more processors that process various data to develop data for controlling various aspects of engine operation. ECU 30 acts via appropriate interfaces with both fuel system 23 and variable valve actuation system 28 to control the timing and amount of fuel injected by each fuel injector and at least the closing of the intake valves.

A representative variable valve actuation system includes devices that allow the basic valve operating profile to be adjusted for each particular cylinder to compensate for cylinder-to-cylinder variations in certain variables, such as temperature, due to the particular location of a cylinder in an engine. A paper by C. Vafidis, "The Application of an Electro-Hydraulic VVA System on a Passenger Car C.R. Diesel Engine", (ATA 20A2011), describes such a system. The paper was presented at the ATA (Associacioni Tecnica De Automobile) Congress on The Future of Diesel Engine Technology for Passenger Cars, Porto Cervo, Italy, 12–13 October 2000.

Controlling both the quantity of fuel injected into a cylinder and the quantity of charge air allowed into the cylinder during an engine cycle for the cylinder controls the proportions of air and fuel in the resulting air-fuel mixture. The quantity of diesel fuel injected into a cylinder is fuel is determined by calculations performed by ECU 30 processing data relevant to such a determination, and resulting fuel injector operation that will cause the calculated quantity to be injected. The quantity of charge air allowed into a cylinder is determined by calculations performed by ECU 30 processing data relevant to such a determination, and resulting closing of the intake valve or valves of the cylinder at a proper time during the compression upstroke.

The creation of the air-fuel mixture occurs early enough to allow the fuel to mix with air before any ignition occurs. The increasing pressure imparted to the mixture eventually results in its auto-ignition near or at engine top dead center (TDC). By proper control of the proportions of fuel and air to run the engine at a desired speed and torque, auto-ignition occurs at the proper time to produce the desired operation of the engine.

For controlling tailpipe emissions, engine 10 operates to recirculate a controlled quantity of exhaust gas through an EGR loop 32 in exhaust system 14. EGR loop 32 has an inlet for engine exhaust coming from engine exhaust manifold 38, an EGR cooler 34 for cooling the hot exhaust gases, and an EGR valve 36 that when open-passes the cooled exhaust gases to an outlet opening to intake system 12. The extent to which exhaust gases can flow through loop 32 is set by how far valve 36 is allowed to open, and that is under the control of ECU 30, which processes data useful in determining the value of a parameter EGRP that sets the amount of valve opening. Hence with valve 36 open, some quantity of exhaust gas is added to the air-fuel mixture in a cylinder by entraining with charge air passing from an intercooler 40 in intake system 12 to an engine intake manifold 42.

A respective pressure transducer 44 is associated with each cylinder 20 to measure in-cylinder pressure and furnish a corresponding data signal to ECU 30.

Figure 2:
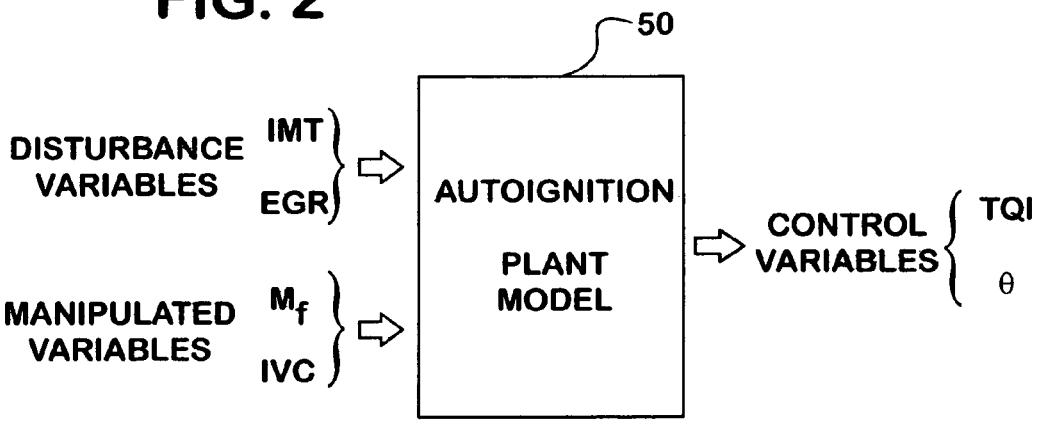
FIG. 2 is a general diagram showing certain input variables and certain output variables associated with operation of the engine of FIG. 1 in accordance with the invention.

FIG. 2 shows certain input variables and certain output variables associated with operation of engine 10 in accordance with principles of the invention. The input variables are grouped into disturbance variables and manipulated variables. The output variables are control variables.

The manipulated variables are engine fueling $m_f$ and intake valve closing IVC. The disturbance variables are intake manifold temperature and exhaust gas recirculation. The control variables are engine torque TQI and timing of auto-ignition $\theta$ during the engine cycle.

ECU 30 comprises algorithms for basic fuel and air management strategies for controlling the respective fuel management and air management systems. Fuel is managed by control of the quantity injected into a cylinder, and that quantity is controlled by controlling parameters relevant to operation of fuel injectors 22, such as injection pressure and injector open time. Air is managed by the time in the engine cycle at which the intake valve or valves of a cylinder are operated closed. Hence parameter $m_f$ is a variable representing a target amount of fuel that should be injected into a cylinder during an engine cycle to form an air-fuel mixture, and parameter IVC is a variable representing the intake valve closing for that same cylinder. As engine speed and load change, the manipulated variables change to cause the engine to operate in a way that delivers the proper torque for the load at the desired speed. Those knowledgeable in engine control strategies will understand that various other factors, not specifically discussed here, bear on the processing that determines the actual data values for engine fueling $m_f$ and intake valve closing IVC.

If variables that are associated with the cylinders were uniform from cylinder to cylinder, each cylinder would be charged with fuel and air in exactly the same way. In an actual engine, that is typically not the case. Cylinder-to-cylinder variations in variables like intake manifold temperature and EGR are likely to exist. The present invention takes those variations into account as disturbance variables.

Figure 3:
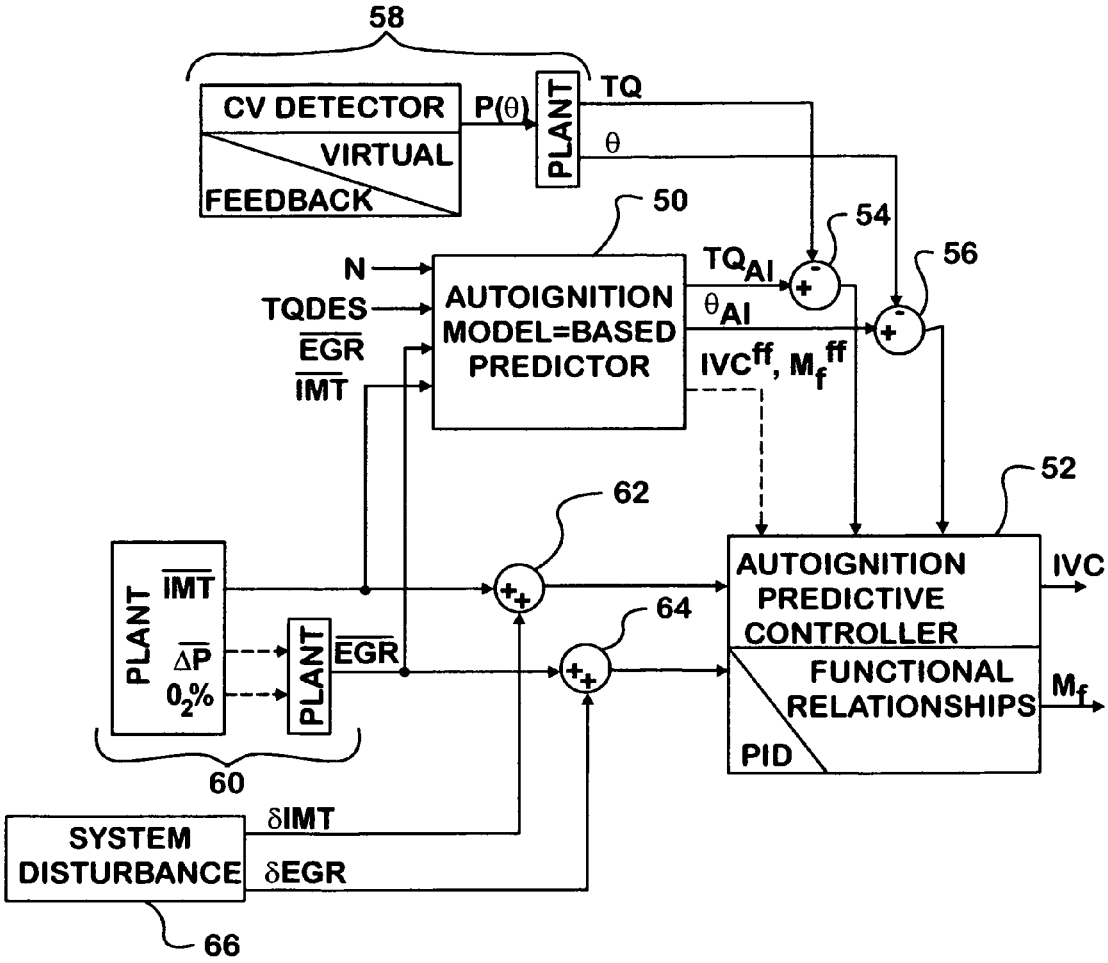
FIG. 3 is a schematic diagram illustrating a detailed implementation of the inventive principles in the engine of FIG. 1.

If charge air enters intake manifold 42 at a particular entrance location, the actual amount of charge air entering a particular cylinder is likely to depend to some extent on how distant its intake valve or valves is or are from the charge air entrance location. The same is true for recirculated exhaust gases. The invention is premised upon modeling an actual engine to ascertain the relevant cylinder-to-cylinder and/or cycle-to-cycle variations. The model 50 is depicted generally in FIG. 2. How that model is implemented in the engine control strategy is shown in FIG. 3.

Model 50 is associated with an auto-ignition predictive controller 52. They comprise algorithms that are repeatedly executed by processing performed by ECU 30 and that collectively form a virtual controller that controls engine fueling and intake valve closing.

Model 50 processes a particular set of values for certain input data useful in predicting the onset of auto-ignition and resulting torque during an engine cycle according to a predictor algorithm model. The particular input data comprises engine speed N, desired torque TQDES, exhaust gas recirculation EGR, and intake manifold temperature IMT. The processing develops a data value for predicted onset of auto-ignition $\theta_{AI}$ and a data value for resulting engine torque $TQ_{AI}$.

A further result of the processing develops a data value for control of the fuel management system and a data value for control of the air management system that will produce the predicted onset of auto-ignition and resulting torque. These two data values are $IVC^{ff}$ and $M_f^{ff}$.

The data values for torque $TQ_{AI}$ and for $\theta_{AI}$ are inputs to respective algebraic summing functions 54, 56 that respectively calculate the difference between $TQ_{AI}$ and actual torque TQ being produced and the difference between $\theta_{AI}$ and the actual time at which auto-ignition occurs $\theta_{AI}$. The differences are in effect error signals that are used in closed loop control of the fuel and air management systems.

A control variable detector 58 resolves engine torque and crank angle at which auto-ignition occurs to provide TQ and θ. Each pressure transducer 44 measures pressure in the corresponding cylinder 20 and the processing of pressure data may comprise integrating the pressure over the combustion cycle to calculate torque and using the instantaneous pressure rise to indicate start of auto-ignition. Alternatively, a virtual instrument comprising an analytical model (simplified thermodynamic and chemistry models based on initial temperature and mixture conditions may give optimum estimates) with the aide of a knock sensor can provide the information.

In FIG. 3, the various references to "Plant" mean data about how the engine (plant) is operating, data that is obtained either from sensors, or that in some way is inferred from other data. The obtained or inferred data is data that is important to control of auto-ignition, such as the intake manifold temperature IMT and the EGR amount. That latter may be obtained by a variety of methods, such as through $O_2$ sampling in intake and exhaust, a hot-film anemometer, a Venturi-style meter, etc.). Reference numeral 60 designates sources that provide data representing measured intake manifold temperature and the EGR amount. Those two data items are inputs to respective summing functions 62, 64.

Disturbances to the variables IMT and EGR are collectively designated by system disturbance 66 in FIG. 3. Such disturbances are the result of cylinder-to-cylinder variations and/or cycle-to-cycle variations, as discussed earlier.

Predictive controller 52 contains stores or maps defining the relationship between the target or desired values of torque and timing of auto-ignition to the manipulative variables, represented here as intake valve closing and fuel delivery. Additionally, the controller incorporates a correction algorithm based on a PID controller that is incorporated in the algorithm that implements closed loop duty-cycle control of both torque and auto-ignition timing.

The algorithm introduces corrections to fueling and to valve timing to project changes in torque and auto-ignition timing as will be more fully explained with reference to FIGS. 4, 5, and 6.

Figures 5, 6:
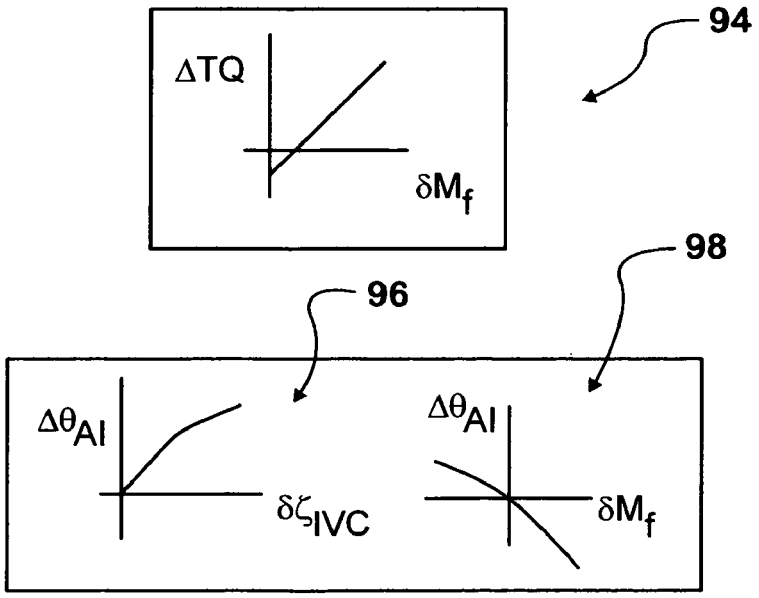
FIG. 5 comprises two equations related to the implementation of the inventive principles.
FIG. 6 comprises additional equations and graph plots involving the inventive principles.

A change in torque ΔTQ is related to a change in valve timing $\delta\zeta_{IVC}$ and to a change in fueling $\delta M_f$ according to the mathematical relationship 90 in FIG. 6. Because a change in valve timing influences torque significantly less than does a change in fueling, torque change ΔTQ may be considered roughly proportional to change in fueling $\delta M_f$ as portrayed by the graphical representation 94 in FIG. 6.

A change in auto-ignition timing $\Delta\theta_{AI}$ is related to a change in valve timing $\delta\zeta_{IVC}$ and to a change in fueling $\delta M_f$ according to the mathematical relationship 92 in FIG. 6. The graphical representations 96, 98 in FIG. 6 respectively show that a positive change in valve timing $\delta\zeta_{IVC}$ will cause a positive change in auto-ignition timing $\Delta\theta_{AI}$ but that a positive change in fueling $\delta M_f$ will cause a negative change in auto-ignition timing $\Delta\theta_{AI}$.

These relationships, which have been developed by the inventor from empirical correlations gathered from engine testing, set forth the basis for the inventor's strategy of simultaneous management of both fuel and air to optimize alternative diesel combustion. With these functional relationships embodied in the controller, fueling and intake valve closing are continually duty-cycle-controlled to increase or decrease the contributions to torque and auto-ignition timing to minimize the error in these two control variables with respect to their desired values.

The PID control of air and fuel by controller 52 processes data values for torque error and auto-ignition timing error to develop respective corrections to the respective duty cycle control of fueling and intake valve timing.

FIG. 5 shows a mathematical relationship 80 that relates fueling correction to torque error and auto-ignition timing error. $\delta_{TQ,dty}$ represents a positive error in torque (insufficient torque being produced), and $\epsilon_{\theta AI,dty}$ represents a positive error in auto-ignition timing (auto-ignition occurred too early). $\alpha_{TQ}$ and $\alpha_{\theta AI}$ are correlation factors that respectively correlate the respective error values (measured in terms of duty cycle) to fueling correction values. $g_{TQ}$ and $g_{\theta AI}$ are gain factors that provide for adjusting the relative contribution of each of the two terms when empirical testing of a particular engine model discloses that it is appropriate to favor the contribution of torque error over auto-ignition timing error, or vice versa, for a certain operating condition. A positive torque error means that more torque is needed and hence fueling needs to be increased. That is why the first term after the equal sign is positive. However, because a positive error in timing of auto-ignition means that auto-ignition occurred to early, fueling should be decreased to make the correction, and that is why the second term after the equal sign is negative.

FIG. 5 also shows a mathematical relationship 82 that relates intake valve timing correction to torque error and auto-ignition timing error. $\beta_{TQ}$ and $\beta_{\theta AI}$ are correlation factors that respectively correlate the respective error values (measured in terms of duty cycle) to timing correction values. $h_{TQ}$ and $h_{\theta AI}$ are gain factors that provide for adjusting the relative contribution of each of the two terms when empirical testing of a particular engine model discloses that it is appropriate to favor the contribution of torque error over auto-ignition timing error, or vice versa, for a certain operating condition. A positive torque error, indicating more power is needed, calls for advancing timing of intake valve closing to make the correction, as reflected by the first term after the equal sign, which is positive. This occurs in conjunction with an increase in fueling by virtue of the fueling correction component based on torque. A positive error in auto-ignition timing, meaning that auto-ignition occurred too early, also calls for advancing timing of intake valve closing to make the correction, as reflected by the second term after the equal sign, which is also positive. This occurs in conjunction with a decrease in fueling by virtue of the fueling correction component based on auto-ignition timing, and the collective effect produces correction in the proper direction because effective compression ratio, and consequently in-cylinder temperature, are both lowered.

Negative torque error and negative auto-ignition timing error produce corrections in the opposite directions from corrections made as a consequence of positive torque error and positive auto-ignition error.

Figure 4:
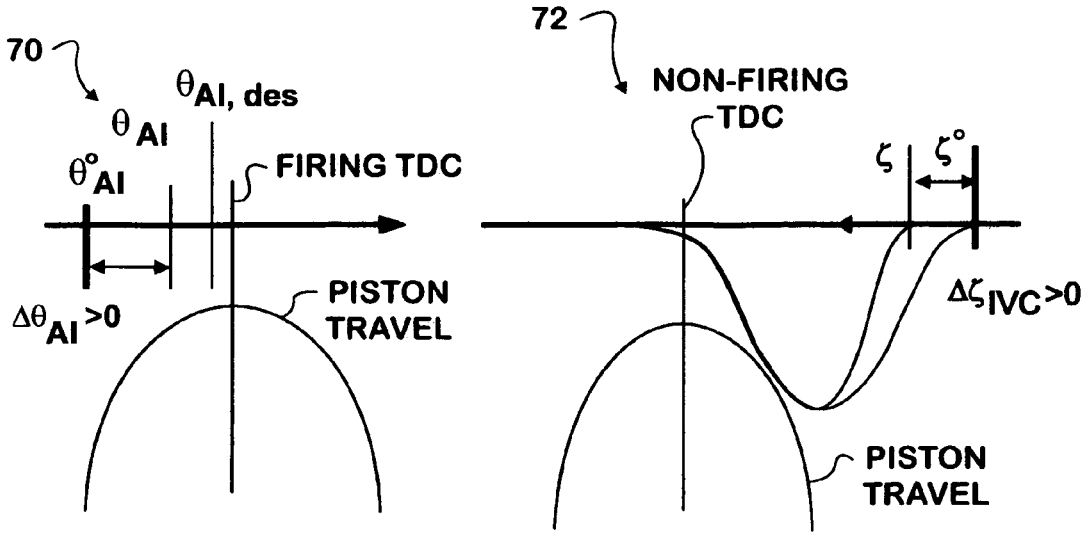
FIG. 4 comprises two graph plots useful in understanding the inventive principles.

A graph 70 in FIG. 4 portrays the general effect of the controller strategy on auto-ignition timing. Let $\theta^{o}_{AI}$ represent timing of auto-ignition before the strategy acts, such as would be measured by detector 58, and $\theta_{AI,des}$ the desired timing, which is closer to engine top dead center (TDC), such as would be provided by model 50. The auto-ignition timing error is the difference, and in this instance positive. As the strategy begins to act, timing of auto-ignition approaches the desired timing. The strategy functions to adjust timing of intake valve closing and fueling in a way that seeks to null out the error, and while auto-ignition timing tends to converge toward the desired, or target, timing, the error may not be completely nulled out. The extent to which error remains will depend to some extent on the particular engine operating conditions.

A graph 72 in FIG. 4 portrays the general effect of the controller strategy on timing of intake valve closing. Let $\zeta^{o}$ represent timing of intake valve closing before the strategy acts, such as would be measured by in any suitably appropriate way. Let $\zeta$ represent the target time of intake valve closing, which earlier in the engine cycle. The timing error is the difference, and in this instance positive. As the strategy begins to act, timing of intake valve closing approaches the desired time. The strategy functions to adjust timing of intake valve closing and fueling in a way that seeks to null out the error, and while timing of intake valve closing tends to converge toward the desired, or target, timing, the error may not be completely nulled out. The extent to which error remains will depend to some extent on the particular engine operating conditions. Collectively, timing of auto-ignition and of intake valve closing are controlled to deliver essentially an optimum solution for both, even when error remain.

By enabling auto-ignition at the desired time in the engine cycle, the resulting combustion temperatures are controlled in ways that avoid the higher temperatures that promote formation of NOx in tailpipe emissions. The present invention provides a control algorithm to make the process of auto-ignition more robust.

Varying intake valve closing on a cylinder-by-cylinder basis varies effective compression ratio on a cylinder-by-cylinder basis. If a particular cylinder has been mapped during engine development (either by modeling or actual experiment) to establish how actual intake manifold temperature may depart from the global value for IMT used as an input to predictor 50 (such global value being obtained for example from a temperature sensor at a particular location), such departures are used to adjust, or compensate, the data value for global IMT in managing fueling and intake valve closing for the particular cylinder. Likewise, if a particular cylinder has been mapped during engine development (either by modeling or actual experiment) to establish how actual EGR may depart from the global value for EGR used as an input to predictor 50, such departures are used to compensate the data value for global EGR in managing fueling and intake valve closing for the particular cylinder.

Hence, the compensation amounts are added to the global values by the summing functions 62, 64, and the sums are used as inputs to controller 52. In the absence of any compensation amount the global value is the input to controller 52.

While a presently preferred embodiment of the invention has been illustrated and described, it should be appreciated that principles of the invention apply to all embodiments falling within the scope of the following claims.

What is claimed is:

1. A multi-cylinder diesel engine that at times operates by an ADC process that causes diesel fuel to be injected into a cylinder in advance of engine TDC and mix with charge air to form an air-fuel mixture that is compressed to auto-ignition as the cycle approaches TDC, the engine comprising:

a fuel management system for controlling fuel in an air-fuel mixture created in a cylinder during an engine cycle;

an air management system for controlling charge air in each air-fuel mixture during an engine cycle;

a processor-based engine control system controlling both the fuel management system and the air management system via a virtual controller that A) processes a particular set of values for certain input data useful in predicting the time of auto-ignition and resulting torque during an engine cycle according to a predictor algorithm model to develop a data value for predicted time of auto-ignition and a data value for resulting engine torque based on the particular set of values for the certain input data, and to also develop a data value for control of the fuel management system and a data value for control of the air management system that will produce the predicted time of auto-ignition and resulting torque based on the particular set of values for the certain input data, and that B) processes the data values developed by the predictor algorithm and data values for at least some of the input data according to a control algorithm that compensates the respective data values for control of the respective management systems for any disturbance that is introduced into any of the data values for at least some of the input data being processed by the control algorithm and consequently causes the respective management systems to be controlled by respective compensated data values that produce the predicted time of auto-ignition and resulting torque in the presence of any such disturbance.

2. An engine as set forth in claim 1 wherein the engine operates to include some amount of recirculated exhaust gas with the air-fuel mixture being compressed, and the certain input data useful in predicting the time of auto-ignition and resulting torque during an engine cycle comprises data representing global engine intake manifold temperature data and data representing global recirculated exhaust gas data.

3. An engine as set forth in claim 2 wherein the engine control system controls air-fuel mixture in each of multiple cylinders via the virtual controller developing respective compensated data values for control of air-fuel mixture in each cylinder that produce the predicted time of auto-ignition and resulting torque in the presence of different disturbances in intake manifold temperature affecting the cylinders as determined by a predefined relationship of intake manifold temperature at each individual cylinder to the global intake manifold temperature data and in the presence of different disturbances in recirculated exhaust gas affecting the cylinders as determined by a predefined relationship of recirculated exhaust gas in each individual cylinder with the global recirculated exhaust gas data.

4. An engine as set forth in claim 1 wherein the engine control system controls air-fuel mixture in each of multiple cylinders via the virtual controller developing respective compensated data values for control of air-fuel mixture in each cylinder that produce the predicted time of auto-ignition and resulting torque in the presence of disturbances in a variable that affect the individual cylinders differently as determined by a predefined relationship, at each individual cylinder, of that variable to a global value for that variable.

5. An engine as set forth in claim 4 comprising a sensor associated with the engine providing data that determines the global value for the variable.

6. An engine as set forth in claim 1 including a source of feedback for providing a data value for actual time of auto-ignition in a cylinder and a data value for actual resulting torque, which data values are processed with the data value for predicted time of auto-ignition and the data value for resulting engine torque based on the particular set of values for the certain input data by the control algorithm, to develop respective error data values that are processed by the control algorithm in closed loop control of the respective management systems.

7. A method of operating a multi-cylinder diesel engine that at times operates by an ADC process that causes diesel fuel to be injected into a cylinder in advance of engine TDC and mix with charge air to form an air-fuel mixture that is compressed to auto-ignition as the cycle approaches TDC, the method comprising:

controlling the quantity of fuel that a fuel management system injects and the quantity of charge air that an air management system allows into an engine cylinder during an engine cycle to create an air-fuel mixture by A) processing a particular set of values for certain input data useful in predicting the time of auto-ignition of the air-fuel mixture during the engine cycle and resulting torque according to an predictor algorithm model in a virtual controller in a processing system to develop a data value for predicted time of auto-ignition and a data value for resulting engine torque based on the particular set of values for the certain input data, and to also develop a data value for control of the fuel management system and a data value for control of the air management system that will produce the predicted time of auto-ignition and resulting torque based on the particular set of values for the certain input data, and B) processing the data values developed by the predictor algorithm and data values for at least some of the input data according to a control algorithm in the virtual controller that compensates the respective data values for control of the respective management systems for any disturbance that is introduced into any of the data values for at least some of the input data being processed by the control algorithm, and consequently C) causing the respective management systems to be controlled by respective compensated data values that cause auto-ignition to occur at the predicted time and develop the resulting torque in the presence of any such disturbance.

8. A method as set forth in claim 7 wherein the engine operates to include some amount of recirculated exhaust gas with the air-fuel mixture being compressed, and the processing of the certain input data useful in predicting the time of auto-ignition and resulting torque during an engine cycle comprises processing data representing global engine intake manifold temperature data and data representing global recirculated exhaust gas data.

9. A method as set forth in claim 8 comprising controlling air-fuel mixture in each of multiple cylinders via the virtual controller developing respective compensated data values for control of air-fuel mixture in each cylinder that produce the predicted time of auto-ignition and resulting torque in the presence of disturbances in intake manifold temperature affecting individual cylinders differently as determined by a predefined relationship of intake manifold temperature at each individual cylinder with the global intake manifold temperature data and in the presence of disturbances in recirculated exhaust gas affecting individual cylinders differently as determined by a predefined relationship of recirculated exhaust gas in each individual cylinder with the global recirculated exhaust gas data.

10. A method as set forth in claim 7 comprising introducing a disturbance into one of the data values for at least some of the input data being processed by the control algorithm as a data value that correlates a predefined relationship of a certain variable at a particular cylinder with a data value for that variable as measured at other than that particular cylinder.

11. A method as set forth in claim 10 comprising measuring the data value for that variable by a sensor associated with the engine.

12. A method as set forth in claim 7 including processing the data value for predicted time of auto-ignition, the data value for resulting engine torque based on the particular set of values for the certain input data, a data value for actual time of auto-ignition in a cylinder, and a data value for actual resulting torque to develop respective error data values, and processing the error data values in closed loop control of the respective management systems.

13. A multi-cylinder diesel engine that at times operates by an ADC process that causes diesel fuel to be injected into a cylinder in advance of engine TDC and mix with charge air to form an air-fuel mixture that is compressed to auto-ignition as the cycle approaches TDC, the engine comprising:

a fuel management system for controlling fuel in an air-fuel mixture created in a cylinder during an engine cycle;

an air management system for controlling charge air in each air-fuel mixture during an engine cycle;

a processor-based engine control system controlling both the fuel management system and the air management system via a virtual controller that executes a control algorithm to develop a data value for the fuel management system to control fuel in a created mixture and a data value for the air management system to control charge air in the created mixture, wherein the algorithm comprises steps that process torque error data representing difference between desired torque and actual torque and auto-ignition timing error data representing difference between desired auto-ignition timing and actual auto-ignition timing according to a mathematical function that relates an adjustment to the data value for the fuel management system to at least the torque error data, and steps that process torque error data and auto-ignition timing error data according to a mathematical function that relates an adjustment to the data value for the air management system to both the torque error data and the auto-ignition timing error data.

14. An engine as set forth in claim 13 wherein the air management system comprises a variable valve timing system for controlling the timing of operation of intake valves at the cylinders, and the data value for the air management system to control charge air in the created mixture controls timing of intake valve closing.

15. An engine as set forth in claim 13 wherein the engine control system further comprises a predictor algorithm that executes steps to develop a predicted data value for auto-ignition timing and a predicted data value for resulting torque, and when executing the control algorithm, the virtual controller uses the predicted data value for auto-ignition timing as the data value for desired auto-ignition timing and the predicted data value for resulting engine torque as the data value for desired engine torque.

16. An engine as set forth in claim 15 wherein the predictor algorithm also executes steps to develop a data value for control of the fuel management system and a data value for control of the air management system that will produce the predicted auto-ignition timing and resulting torque based on a particular set of data values for certain input data processed by the predictor algorithm, and the control algorithm processes the data values for control of the fuel and air management systems developed by the predictor algorithm and the particular data values for at least some of the certain input data processed by the predictor algorithm to compensate the data values for control of the fuel and air management systems developed by the predictor algorithm for any disturbance that is introduced into any of the data values for at least some of the certain input data being processed by the control algorithm and consequently cause the respective management systems to be controlled by respective compensated data values for producing the predicted time of auto-ignition and resulting torque in the presence of any such disturbance.

17. An engine as set forth in claim 16 wherein the engine control system controls air-fuel mixture in each of multiple cylinders via the virtual controller developing respective compensated data values for control of air-fuel mixture in each cylinder that produce the predicted auto-ignition timing and resulting torque in the presence of different disturbances in a variable affecting the cylinders as determined by a predefined relationship of that variable at each individual cylinder with a global value for that variable.

18. A method of operating a multi-cylinder diesel engine that at times operates by an ADC process that causes diesel fuel to be injected into a cylinder in advance of engine TDC and mix with charge air to form an air-fuel mixture that is compressed to auto-ignition as the cycle approaches TDC, the method comprising:

controlling both a fuel management system and an air management system via a virtual controller executing a control algorithm that develops a data value for the fuel management system to control fuel in a created mixture and a data value for the air management system to control charge air in the created mixture, wherein the algorithm calculates a data value for torque error representing difference between desired torque and actual torque and a data value for auto-ignition timing error representing difference between desired auto-ignition timing and actual auto-ignition timing, according to respective mathematical functions that respectively relate an adjustment to the data value for the fuel management system to at least the torque error data and an adjustment to the data value for the air management system to both the torque error data and the auto-ignition timing error data.

19. A method as set forth in claim 18 comprising controlling the air management system by controlling the timing of operation of intake valves at the cylinders using the data value for the air management system to control charge air in the created mixture to control timing of intake valve closing.

20. A method as set forth in claim 18 further comprising executing steps of a predictor algorithm to develop a predicted data value for auto-ignition timing and a predicted data value for resulting torque, and during execution of the control algorithm, using the predicted data value for auto-ignition timing as the data value for desired auto-ignition timing and the predicted data value for resulting engine torque as the data value for desired engine torque.

21. A method as set forth in claim 20 further comprising executing steps of the predictor algorithm to also develop a data value for control of the fuel management system and a data value for control of the air management system that will produce the predicted auto-ignition timing and resulting torque based on a particular set of data values for certain input data processed during execution of the predictor algorithm, and executing steps of the control algorithm that process the data values for control of the fuel and air management systems developed by the predictor algorithm and the particular data values for at least some of the certain input data processed by the predictor algorithm to compensate the data values for control of the fuel and air management systems developed by the predictor algorithm for any disturbance that is introduced into any of the data values for at least some of the certain input data being processed by the control algorithm and consequently causing the respective management systems to be controlled by respective compensated data values for producing the predicted time of auto-ignition and resulting torque in the presence of any such disturbance.

22. A method as set forth in claim 21 comprising controlling air-fuel mixture in each of multiple cylinders via respective compensated data values for control of air-fuel mixture in each cylinder that produce the predicted auto-ignition timing and resulting torque in the presence of different disturbances in a variable affecting the cylinders as determined by a predefined relationship of that variable at each individual cylinder with a global value for that variable.

* * * * *